US007288352B2

(12) United States Patent
Pickering

(10) Patent No.: US 7,288,352 B2
(45) Date of Patent: Oct. 30, 2007

(54) TONER COMPOSITIONS WITH SURFACE ADDITIVES

(75) Inventor: Thomas R. Pickering, Webster, NY (US)

(73) Assignee: Xerox Corporation, Stamford, CT (US)

( * ) Notice: Subject to any disclaimer, the term of this patent is extended or adjusted under 35 U.S.C. 154(b) by 280 days.

(21) Appl. No.: 11/119,725

(22) Filed: May 3, 2005

(65) Prior Publication Data

US 2006/0251978 A1 Nov. 9, 2006

(51) Int. Cl.
*G03G 9/08* (2006.01)

(52) U.S. Cl. ..... 430/108.3; 430/108.4; 430/108.6; 430/108.7; 430/137.1

(58) Field of Classification Search ..... 430/108.3, 430/108.4, 108.6, 108.7, 137.1
See application file for complete search history.

(56) References Cited

U.S. PATENT DOCUMENTS

| | | | | |
|---|---|---|---|---|
| 3,590,000 | A | 6/1971 | Palermiti et al. | |
| 4,265,990 | A | 5/1981 | Stolka et al. | |
| 4,298,672 | A | 11/1981 | Lu | |
| 4,338,390 | A | 7/1982 | Lu | |
| 4,558,108 | A | 12/1985 | Alexandru et al. | |
| 4,563,408 | A | 1/1986 | Lin et al. | |
| 4,584,253 | A | 4/1986 | Lin et al. | |
| 4,585,884 | A | 4/1986 | Lin et al. | |
| 4,883,736 | A | 11/1989 | Hoffend et al. | |
| 4,935,326 | A | 6/1990 | Creatura et al. | |
| 4,937,166 | A | 6/1990 | Creatura et al. | |
| 5,352,556 | A | 10/1994 | Mahabadi et al. | |
| 5,545,501 | A | 8/1996 | Tavernier et al. | |
| 6,004,714 | A | 12/1999 | Ciccarelli et al. | |
| 6,017,668 | A | 1/2000 | Young et al. | |
| 6,071,665 | A | 6/2000 | Dickerson et al. | |
| 6,087,059 | A | 7/2000 | Duggan et al. | |
| 6,103,440 | A | 8/2000 | Lohr | |
| 6,124,071 | A | 9/2000 | Lin et al. | |
| 6,177,221 | B1 * | 1/2001 | Maniar et al. | 430/111.3 |
| 2004/0063018 | A1 | 4/2004 | Silence et al. | |
| 2006/0003244 | A1 * | 1/2006 | Grande et al. | 430/106.2 |

FOREIGN PATENT DOCUMENTS

| | | |
|---|---|---|
| GB | 1442835 | 7/1976 |

OTHER PUBLICATIONS

U.S. Appl. No. 10/980,234, filed Nov. 4, 2004, Silence et al.

* cited by examiner

*Primary Examiner*—Mark A. Chapman
(74) *Attorney, Agent, or Firm*—Oliff & Berridge PLC

(57) ABSTRACT

A toner composition including a binder, a colorant, and a surface additive package including a surface treated silica, a surface treated titania, and magnesium stearate.

20 Claims, 3 Drawing Sheets

TONER COMPOSITIONS WITH SURFACE ADDITIVES

BACKGROUND

This disclosure relates generally to toner compositions having improved properties that are provided by improved surface additives. More particularly, the present disclosure relates to toner and developer compositions where the toner particles have an external additive mixture of treated silica, treated titania, and magnesium stearate. The disclosure also relates to developers containing such toners, processes for making such toners and developers, and methods for generating developed images with such toners and developers.

In electrophotography, a photoreceptor containing a photoconductive insulating layer on a conductive layer is imaged by first uniformly electrostatically charging its surface. The photoreceptor is then exposed to a pattern of activating electromagnetic radiation, such as light. The radiation selectively dissipates the charge in the illuminated areas of the photoconductive insulating layer while leaving behind an electrostatic latent image in the non-illuminated areas. This electrostatic latent image may then be developed to form a visible image by depositing finely divided toner particles on the surface of the photoconductive insulating layer. The resulting visible image may then be transferred from the photoconductor to a support, such as transparency or paper. This imaging process may be repeated many times.

Various toner compositions for such a printing system are well known in the art, and have been produced having a wide range of additives and constituent materials. Generally, however, the toner particles include a binding material such as a resin, a colorant such as a dye and/or a pigment, and any of various additives to provide particular properties to the toner particles.

One such commonly used toner additive is zinc stearate. Zinc stearate is routinely added to toner particles, as either an internal or external additive, for example as a lubricant, flow aid, conductivity aid, and the like. However, it has been found in some toner compositions that zinc stearate leads to early toner and developer failure, such as by reacting with other toner or developer components or other machine components to cause machine failure. For example, it has been found that zinc stearate present in the toner or developer compositions can react with the fuser oil, creating reaction products that lead to fuser roll contamination and stripping failure.

U.S. Pat. No. 5,545,501 describes an electrostatographic developer composition comprising carrier particles and toner particles with a toner particle size distribution having a volume average particle size (T) such that 4 μm≦T≦12 μm, and an average charge (absolute value) pro diameter in femtocoulomb/10 μm ($C_T$) after triboelectric contact with the carrier particles such that 1 fC/10 μm≦$C_T$≦10 fC/10 μm, and wherein (i) the carrier particles have a saturation magnetization value, $M_{sat}$, expressed in Tesla (T) such that $M_{sat}$≧0.30 T; (ii) the carrier particles have a volume average particle size ($C_{avg}$) such that 30 μm≦$C_{avg}$≦60 μm; (iii) the volume based particle size distribution of the carrier particles has at least 90 percent of the particles having a particle diameter C such that 0.5 $C_{avg}$≦C≦2 $C_{avg}$; (iv) the volume based particles size distribution of the carrier particles comprises less than b percent particles smaller than 25 μm wherein b=0.35.times.$(M_{sat})^2$×P with $M_{sat}$: saturation magnetization value, $M_{sat}$, expressed in T and P, the maximal field strength of the magnetic developing pole expressed in kA/m, and (v) the carrier particles comprise a core particle coated with a resin coating in an amount (RC) such that 0.2 percent w/w≦RC≦2 percent w/w, see the Abstract. This patent indicates that the developers thereof can achieve images when a latent image is developed with a fine hair magnetic brush.

Nevertheless, there continues to be a need for a set of developers comprised of toners and carriers that possess a combination of properties such that when used to develop a latent image on the surface of a photoreceptor, preferably in an image-on-image device, and more specifically, in such a device also utilizing a hybrid scavengeless development system, the color image produced exhibits a quality analogous to that achieved in offset lithography. Further, there is a need for toners and developers wherein a toner additive does not substantially interact with fuser oils, fuser rolls, and the like to thereby, for example, increase the useable life, for example from about 200,000 prints to about 1,000,000 prints, of fuser devices, such as fuser rolls, and wherein the toners and developers thereof possess excellent triboelectrical, conductivity, and developability characteristics.

One approach for addressing these needs is shown in U.S. Patent Publication No. 20040063018, the entire disclosure of which is incorporated herein by reference. In the publication, toner and developer compositions are disclosed that comprise at least one binder in an optional amount of from about 85 to about 99 percent by weight, at least one colorant in an optional amount of from about 0.5 to about 15 percent by weight, and calcium stearate in an optional amount of from about 0.05 to about 2 percent by weight.

Another approach for addressing these needs is shown in commonly-owned U.S. patent application Ser. No. 10/980,234 filed Nov. 4, 2004, the entire disclosure of which is incorporated herein by reference. In this application, improved toner and developer compositions are described. The toner compositions include a binder, a colorant, and a surface additive package comprising a polydimethylsiloxane surface treated silica, a surface treated titania, and calcium stearate. Calcium stearate is described as providing improved benefits over zinc stearate, in terms of narrower range of variation (sensitivity) of the triboelectric charge across the A, B and J zones.

However, it has been found that calcium stearate as a surface additive, while providing significant improved results over the prior toner compositions, leads to some problems of its own. For example, it has been found that calcium stearate can lead to LCM and donor roll wire contamination. LCM stands for Lateral Charge Migration, a situation where the charge of an image bleeds off to the side causing the image to become blurred.

Despite the various attempts to provide toner and developer compositions for providing high quality print results, problems still remain. For example, as the end-user demands for higher quality prints increases, and as the printing apparatuses are utilized in a wider variety of environments, increasing demands are being placed on the printing apparatuses and the toner and developer compositions. Thus, while particular printing apparatuses and toner and developer compositions are designed to provide adequate results over a wide range of customer job types and operating conditions, those parameters are being widened to increase the performance demands.

One such demand is the triboelectric charging values of the toner and developer compositions. The conventional range for developer triboelectric charging values is generally accepted to be from about 25 to about 50 μC/g. This range is limited on the lower end by macrouniformity (half-tone mottle), dirt, emissions, spittings, and gaps and traps defects;

and is limited on the higher end by transfer image quality defects. While this range provides high quality print results for a large proportion of the end-users, there exists a "tail" of end-users at both ends, where operating conditions provide less than superior print results. These tail operation conditions are driven primarily by inherent variations in the machines and compositions as produced, as well as variation in the developer toner concentration, ambient temperature and relative humidity conditions, and age of the developer components. Relative humidity can be somewhat controlled, by using an environmental unit in the print cavity to dehumidify the print cavity and to control humidity on the high end, and a humidifier in the room housing the printing apparatus to control humidity on the low end. However, this requirement for the end-user to provide humidification control is difficult in some cases and thus is undesirable.

SUMMARY

This disclosure addresses some or all of the above problems, and others, by providing toner and developer compositions where the toner composition includes a novel additive package to control triboelectric charging to within a desired range. This disclosure thus relates to toners, developers containing toners, processes thereof, and methods for generating developed images with, for example, high print quality.

It is a feature of the present disclosure to provide toner and developer compositions having a set of properties such that the developers containing such toners can achieve xerographically produced images having high print quality.

It is a still further feature of the disclosure to provide processes for the preparation of the toners and developers with certain consistent, and predictable properties.

Furthermore, another feature of the present disclosure relates to the selection of magnesium stearate as a lubricant component for toners and developers thereof that, in combination with other components of an external additive package, optimize the triboelectric charging response to age of the toner and developer, and provide a sufficiently high triboelectric charge to allow tenability of the developer by appropriate carrier choice.

More particularly, in embodiments, the present disclosure provides a toner composition comprising:

a binder, a colorant, and a surface additive package comprising a surface treated silica, a surface treated titania, and magnesium stearate.

The present disclosure also provides developers including such a toner composition, and methods for making and using such toner and developer compositions.

BRIEF DESCRIPTION OF THE DRAWINGS

These and other advantages and features of this disclosure will be apparent from the following, especially when considered with the accompanying drawings, in which.

DETAILED DESCRIPTION OF PREFERRED EMBODIMENTS

Figure 1:
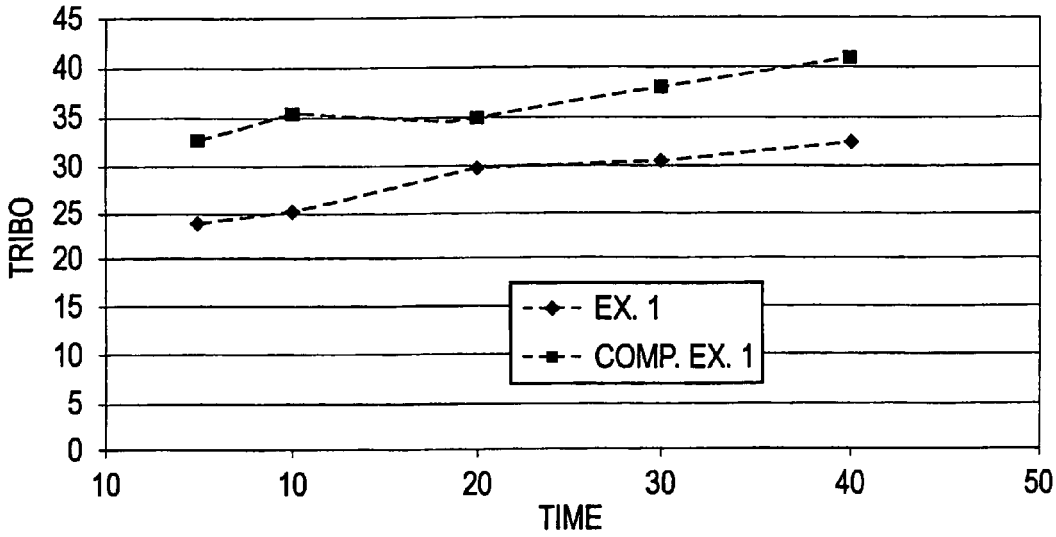
FIG. 1 is a graph showing measured triboelectric charge for control developers and developers according to an embodiment of the disclosure, as a function of simulated toner age.

According to the present disclosure, a toner is provided that includes at least a binder, a colorant, and a surface additive package. The surface additive package comprises a surface treated silica, a surface treated titania, and magnesium stearate. The additive package is used as an external additive to the toner composition. That is, the toner particles per se are first formed, followed by mixing of the toner particles with the materials of the additive package. The result is that the additive package generally coats or adheres to external surfaces of the toner particles, rather than being incorporated into the bulk of the toner particles.

The first component of the additive package is a surface treated silica. In embodiments, any suitable surface treated silica can be used, and many varieties are known and available in the art. Such surface treated silicas can be used alone, as only one surface treated silica, or can be used in combination, such as two or more surface treated silicas. Where two or more surface treated silicas are used in combination, it is preferred (although not required) that one of the surface treated silicas be a polydimethylsiloxane (PDMS) surface treated silica. Preferably, the silica of the polydimethylsiloxane (PDMS) surface treated silica is a fumed silica.

Conventional surface treated silica materials are known and include, for example, TS-530 from Cabosil Corporation, with an 8 nanometer particle size and a surface treatment of hexamethyidisilazane; NAX50, obtained from DeGussa/Nippon Aerosil Corporation, coated with HMDS; DTMS (decyl trimethoxysilane) silica, obtained from Cabot Corporation, comprised of a fumed silica silicon dioxide core that has a surface area o fof 90 $m^2$/gram and is coated with DTMS; H2050EP, obtained from Wacker Chemie, coated with an amino functionalized organopolysiloxane; and the like. Such conventional surface treated silicas are applied to the toner surface for toner flow, triboelectric charge enhancement, admix control, improved development and transfer stability, and higher toner blocking temperature.

However, the present inventors have found that a specific surface treated silica, a silica surface treated with polydimethylsiloxane (PDMS), unexpectedly provides superior performance results to the final toner composition when used in combination with a surface treated titania and magnesium stearate in an additive package. In particular, the present inventors have found that the polydimethylsiloxane (PDMS) surface treated silica, when used in combination with a surface treated titania and magnesium stearate in an additive package, provides higher triboelectric charge in different temperature/humidity environments, and provides different and desirable performance response in printing environments.

Specific examples of suitable PDMS-surface treated silicas include, for example, but are not limited to, RY50, NY50, RY200, RY200S and R202, all available from Nippon Aerosil, and the like.

The polydimethylsiloxane (PDMS) surface treated silica is preferably present in an amount of from about 1 to about 10 percent by weight, based on a weight of the toner particles without the additive (i.e., in an amount of from about 1 to about 10 parts by weight additive per 100 parts by weight toner particle). More preferably, in embodiments, the PDMS surface treated silica is present in an amount of from about 1.5 or from about 2 to about 5.5 or to about 6 percent by weight, such as from about 2.3 or about 2.5 to about 4.3 or about 4.5 percent by weight. However, weight percents outside of these ranges can be used, if desired.

Preferably, according to embodiments, the polydimethylsiloxane (PDMS) surface treated silica is the only surface treated silica present in the toner composition. Alternatively, for example where small amounts of other silicas are introduced into the toner composition for other purposes, such as to assist toner particle classification and separation, the polydimethylsiloxane (PDMS) surface treated silica is the only xerographically active surface treated silica present in the toner composition. Any other incidentally present silica thus does not significantly affect any of the xerographic printing properties. Preferably, the polydimethylsiloxane (PDMS) surface treated silica is the only surface treated silica present in the additive package applied to the toner composition.

The second component of the additive package is a surface treated titania. Preferably, the surface treated titania used in embodiments is a hydrophobic surface treated titania.

Conventional surface treated titania materials are known and include, for example, metal oxides such as $TiO_2$, for example MT-3103 from Tayca Corp. with a 16 nanometer particle size and a surface treatment of decylsilane; SMT5103, obtained from Tayca Corporation, comprised of a crystalline titanium dioxide core MT500B coated with DTMS; P-25 from Degussa Chemicals with no surface treatment; an isobutyltrimethoxysilane (I-BTMS) treated hydrophobic titania obtained from Titan Kogyo Kabushiki Kaisha (IK Inabata America Corporation, New York); and the like. Such surface treated titania are applied to the toner surface for improved relative humidity (RH) stability, triboelectric charge control and improved development and transfer stability.

However, the present inventors have found that specific surface treated titania materials unexpectedly provides superior performance results to the final toner composition. Thus, while any of the surface treated titania may be used in the external additive package, in embodiments it is preferred that the material be a "large" surface treated titania (i.e., one having an average particle size of from about 30 to about 50 nm, or from about 35 to about 45 nm, particularly about 40 nm). In particular, the present inventors have found that the preferred surface treated titania provides one or more of better cohesion stability of the toners after aging in the toner housing, and higher toner conductivity, which increases the ability of the system to dissipate charge patches on the toner surface.

Specific examples of suitable surface treated titanias include, for example, but are not limited to, an isobutyltrimethoxysilane (I-BTMS) treated hydrophobic titania obtained from Titan Kogyo Kabushiki Kaisha (IK Inabata America Corporation, New York); SMT5103, obtained from Tayca Corporation, comprised of a crystalline titanium dioxide core MT500B coated with DTMS (decyltrimethoxysilane); and the like. The isobutyltrimethoxysilane (I-BTMS) treated hydrophobic titania is particularly preferred, in some embodiments.

The silicas and titanias should more specifically possess a primary particle size greater than approximately 30 nanometers, preferably of at least 40 nanometers, with the primary particles size measured by, for instance, transmission electron microscopy (TEM) or calculated (assuming spherical particles) from a measurement of the gas absorption, or BET, surface area. Titania is found to be especially helpful in maintaining development and transfer over a broad range of area coverage and job run length. The silica and titania are more specifically applied to the toner surface with the total coverage of the toner ranging from, for example, as low as about 60% or about 70% to as high as about 200% theoretical surface area coverage (SAC), preferably from about 70% or about 100% to about 200% theoretical surface area coverage (SAC), where the theoretical SAC (hereafter referred to as SAC) is calculated assuming all toner particles are spherical and have a diameter equal to the volume median diameter of the toner as measured in the standard Coulter Counter method, and that the additive particles are distributed as primary particles on the toner surface in a hexagonal closed packed structure. Another metric relating to the amount and size of the additives is the sum of the "SAC×Size" (surface area coverage times the primary particle size of the additive in nanometers) for each of the silica and titania particles, or the like, for which all of the additives should, more specifically, have a total SAC×Size range of, for example, from about 2,400 to about 8,000, preferably in embodiments from about 4,500 to about 7,200. The ratio of the silica to titania particles is generally from about 50 percent silica/50 percent titania to about 85 percent silica/15 percent titania (on a weight percentage basis), although the ratio may be larger or smaller than these values provided that the features of the disclosure are achieved.

The surface treated titania is preferably present in an amount of from about 0.1 to about 5 percent by weight, based on a total weight of the toner particles. More preferably, in embodiments, the surface treated titania is present in an amount of from about 0.2 or from about 0.3 to about 1.0 or to about 2.0 percent by weight. However, weight percents outside of these ranges can be used, if desired.

Preferably, according to embodiments, only one surface treated titania is present in the toner composition. That is, in some embodiments, it is preferred that only one kind of surface treated titania be present, rather than a mixture of two or more different surface treated titanias.

The third component of the additive package is magnesium stearate.

Magnesium stearate is used in the additive package of the present disclosure primarily to provide lubricating properties. Also, the magnesium stearate can provide developer conductivity and triboelectric charge enhancement, both due to its lubricating nature. In addition, magnesium stearate has been found to enable higher toner charge and charge stability by increasing the number of contacts between toner and carrier particles.

Any suitable magnesium stearate can be used in the additive package. However, it is preferred that the magnesium stearate, preferably commercially available, has greater than about 85 percent purity, for example from about 85 to about 100 percent purity. For example, the 85 percent pure magnesium stearate preferably has less than 12 percent magnesium oxide and free fatty acid by weight, and less than 3 percent moisture content by weight. The magnesium stearate also preferably has an average particle diameter of about 7 microns. A suitable magnesium stearate meeting these preferred parameters is MM-2, available from NOF Corporation. Most preferred is a commercially available magnesium stearate with greater than 95 percent purity (less than 0.5 percent magnesium oxide and free fatty acid by weight, and less than 4.5 percent moisture content by weight), and which magnesium stearate has an average particle diameter of about 2 microns and is available from NOF Corporation (Tokyo, Japan) as MM-2.

The magnesium stearate is preferably present in an amount of from about 0.01 to about 10 percent by weight, based on a total weight of the toner particles. More preferably, in embodiments, the magnesium stearate is present in an amount of from about 0.05 or from about 0.1 to about 2.5 or to about 5.0 percent by weight. However, weight percents outside of these ranges can be used, if desired.

Preferably, according to embodiments, the magnesium stearate is the only metal carboxylate, or at least the only metal stearate, present in the toner composition. Thus, for example, it is preferred in some embodiments that no other metal carboxylates, such as zinc stearate or calcium stearate, be present in the toner composition.

The components of the additive package are selected to enable superior toner flow properties, high toner charge and charge stability. The surface treatments on the silica and titania, the relative amounts of the silica and titania (for example about 90 percent silica:about 10 percent titania (all percentages are by weight) to about 10 percent silica:about 90 percent titania), and the amount of magnesium stearate can be manipulated to provide a range of toner charge values. For example, toner charge values can be provided ranging from about 10 μC/g to about 60 μC/g, as measured by the standard Faraday Cage technique.

Thus, for example, in embodiments, the toners contain from, for example, about 1 to about 5 weight percent PDMS surface treated silica, about 0.2 to about 1.5 weight percent surface treated titania, and about 0.05 to about 0.5 weight percent magnesium stearate. Exemplary toner compositions may thus include, for example, about 3.3 weight percent PDMS surface treated silica, about 0.9 weight percent surface treated titania, and about 0.1 weight percent magnesium stearate, or about 4.3 weight percent PDMS surface treated silica, about 0.9 weight percent surface treated titania, and about 0.1 or 0.2 weight percent magnesium stearate. Of course, these range are exemplary only, and values outside these ranges can be used, in embodiments.

For further enhancing the positive charging characteristics of the toner developer compositions, and as optional components there can be incorporated into the toner or on its surface charge enhancing additives inclusive of alkyl pyridinium halides, reference U.S. Pat. No. 4,298,672, the disclosure of which is totally incorporated herein by reference; organic sulfate or sulfonate compositions, reference U.S. Pat. No. 4,338,390, the disclosure of which is totally incorporated herein by reference; distearyl dimethyl ammonium sulfate; bisulfates, and the like, and other similar known charge enhancing additives. Also, negative charge enhancing additives may also be selected, such as aluminum complexes, like BONTRON E-88®, and the like. These additives may be incorporated into the toner in an amount of from about 0.1 percent by weight to about 20 percent by weight, and more specifically from about 1 to about 3 percent by weight.

The toner compositions of the present disclosure, in addition to including the above-described additive package, generally also include at least a toner resin and a colorant. In addition, the toner compositions can include one or more conventional additives, including but not limited to, optional charge enhancing additives and optional waxes, especially low molecular weight waxes with an Mw of, for example, from about 1,000 to about 20,000. Suitable toner compositions, which can be modified to include the above-described external additive package of the present disclosure, include those toner compositions disclosed in, for example, U.S. Pat. Nos. 6,004,714, 6,017,668, 6,071,665, 6,087,059, 6,103,440, and 6,124,071, and U.S. Patent Publication No. 20040063018, the entire disclosures of which are incorporated herein by reference. The toner compositions can generally be prepared by any known technique, such as by admixing and heating resin particles, colorant, and optional additives other than the above-described surface additive in a suitable toner extrusion device, such as the ZSK58 available from Werner Pfleiderer, following by removing the formed toner composition from the device. Subsequent to cooling, the toner composition is subjected to grinding utilizing, for example, a Sturtevant micronizer for the purpose of achieving toner particles with a desired volume median diameter of, for example, less than about 25 microns, and preferably of from about 6 to about 12 microns, which diameters are determined by a Coulter Counter. Subsequently, the toner compositions can be classified utilizing, for example, a Donaldson Model B classifier for the purpose of removing fines, that is toner particles having a volume median diameter of less than about 4 microns. Thereafter, the above-described external additive package and other optional surface additives can be added to the toner composition by blending the additives with the obtained toner particles.

As the toner (or binder) resin, any of the convention toner resins can be used. Illustrative examples of such suitable toner resins include, for example, thermoplastic resins such as vinyl resins in general or styrene resins in particular, and polyesters. Examples of suitable thermoplastic resins include, but are not limited to, styrene methacrylate; polyolefins; styrene acrylates, such as PSB-2700 obtained from Hercules-Sanyo Inc.; polyesters, styrene butadienes; crosslinked styrene polymers; epoxies; polyurethanes; vinyl resins, including homopolymers or copolymers of two or more vinyl monomers; and polymeric esterification products of a dicarboxylic acid and a diol comprising a diphenol. Other suitable Vinyl monomers include, but are not limited to, styrene; p-chlorostyrene; unsaturated mono-olefins such as ethylene, propylene, butylene, isobutylene and the like; saturated mono-olefins such as vinyl acetate, vinyl propionate, and vinyl butyrate; vinyl esters such as esters of monocarboxylic acids including methyl acrylate, ethyl acrylate, n-butylacrylate, isobutyl acrylate, dodecyl acrylate, n-octyl acrylate, phenyl acrylate, methyl methacrylate, ethyl methacrylate, and butyl methacrylate; acrylonitrile, methacrylonitrile, and acrylamide; mixtures thereof; and the like. In addition, crosslinked resins, including polymers, copolymers, and homopolymers of styrene polymers, may be selected.

For example, as one toner resin, there can be selected the esterification products of a dicarboxylic acid and a diol comprising a diphenol. These resins are illustrated, for example, in U.S. Pat. No. 3,590,000, the entire disclosure of which is incorporated herein by reference. Other specific toner resins include, but are not limited to, styrene/methacrylate copolymers, and styrene/butadiene copolymers; Pliolites; suspension polymerized styrene butadienes, reference U.S. Pat. No. 4,558,108, the entire disclosure of which is incorporated herein by reference; polyester resins obtained from the reaction of bisphenol A and propylene oxide; followed by the reaction of the resulting product with fumaric acid, and branched polyester resins resulting from the reaction of dimethylterephthalate, 1,3-butanediol, 1,2-propanediol, and pentaerythritol; reactive extruded resins, especially reactive extruded polyesters with crosslinking as illustrated in U.S. Pat. No. 5,352,556, the entire disclosure of which is incorporated herein by reference, styrene acrylates, and mixtures thereof. Also, waxes with a molecular weight Mw of from about 1,000 to about 20,000, such as polyethylene, polypropylene, and paraffin waxes, can be included in, or on the toner compositions as fuser roll release agents.

The toner resin is generally present in any sufficient, but effective amount. For example, the toner resin is generally present in an amount of from about 50 to about 95 percent by weight of the toner composition. More preferably, the toner resin is generally present in an amount of from about 70 to about 90 percent by weight of the toner composition.

The toner composition also generally includes a colorant. As desired, the colorant can be a dye, a pigment, a mixture of a dye and a pigment, or two or more of them. As colored pigments, there can be selected, for example, various known cyan, magenta, yellow, red, green, brown, or blue colorants, or mixtures thereof. Specific examples of pigments include, but are not limited to, phthalocyanine HELIOGEN BLUE L6900™, D6840™, D7080™, D7020™, PYLAM OIL BLUE™, PYLAM OIL YELLOW™, PIGMENT BLUE 1™, available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, CINQUASIA MAGENTATA™ available from E.I. DuPont de Nemours & Company, Pigment Yellow 180, Pigment Yellow 12, Pigment Yellow 13, Pigment Yellow 14, Pigment Yellow 17, Pigment Blue 15, Pigment Blue 15:3, Pigment Red 122, Pigment Red 57:1, Pigment Red 81:1, Pigment Red 81:2, Pigment Red 81:3, and the like.

Generally, colored dyes and pigments that can be selected are cyan, magenta, or yellow pigments, and mixtures thereof. Examples of magentas that may be selected include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyans that may be selected include copper tetra(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like. Illustrative examples of yellows that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Other soluble dyes, such as red, blue, green, and the like, can also be used, as desired.

Generally, the colorant is included in the toner composition in known amounts, for the desired color strength. For example, the above-described dyes and pigments, and others, can be included in the toner composition in any suitable amount, such as from about 1 to about 20 percent by weight of the toner composition. Preferably, the colorant is included in an amount of from about 2 to about 10 percent by weight of the toner composition.

If desired, such as to give the toner composition magnetic properties, magnetites can also be included in the toner composition, either for their magnetic properties, or for the colorant properties, or both. Suitable magnetites that can be used in the toner compositions of the present disclosure include, but are not limited to, a mixture of iron oxides ($FeO.Fe_2O_3$), including those commercially available as MAPICO BLACK™. The magnetite can be present in the toner composition in any of various effective amounts, such as an amount of from about 10 percent by weight to about 75 percent by weight of the toner composition. Preferably, the magnetite is present in an amount of from about 30 percent to about 55 percent by weight of the toner composition.

There can be included in the toner compositions of the present disclosure charge additives as indicated herein in various effective amounts, such as from about 1 to about 15, and preferably from about 1 to about 3, percent by weight of the toner composition. Such suitable charge additives can include the above-described external additive package, or other charge additives well known in the art.

Furthermore, the toner compositions of the present disclosure can also include suitable waxes for their known effect. Suitable waxes include, but are not limited to, polypropylenes and polyethylenes commercially available from Allied Chemical and Petrolite Corporation; Epolene N-15 commercially available from Eastman Chemical Products, Inc.; Viscol 550-P, a low weight average molecular weight polypropylene available from Sanyo Kasei K.K.; mixtures thereof, and the like. The commercially available polyethylenes selected possess, for example, a weight average molecular weight of from about 1,000 to about 1,500, while the commercially available polypropylenes utilized are believed to have a weight average molecular weight of from about 4,000 to about 7,000. Many of the polyethylene and polypropylene compositions useful in the present disclosure are illustrated in British Patent No. 1,442,835, the entire disclosure of which is incorporated herein by reference.

The wax can be present in the toner composition of the present disclosure in various amounts. However, generally these waxes are present in the toner composition in an amount of from about 1 percent by weight to about 15 percent by weight, and preferably in an amount of from about 2 percent by weight to about 10 percent by weight, based on the weight of the toner composition.

The toners of the present disclosure may also, in embodiments, contain polymeric alcohols, such as UNILINS™, reference U.S. Pat. No. 4,883,736, the entire disclosure of which is incorporated herein by reference. The UNILINS™ products are available from Petrolite Corporation.

Developer compositions can be prepared by mixing the toners with known carrier particles, including but not limited to coated carriers, such as steel, ferrites, and the like, reference U.S. Pat. Nos. 4,937,166 and 4,935,326, the entire disclosures of which are incorporated herein by reference. The toner composition and carrier particles are generally mixed to include from about 2 percent toner concentration to about 8 percent toner concentration. The carriers can include coatings thereon, such as those illustrated in the above-referenced U.S. Pat. Nos. 4,937,166 and 4,935,326 patents, and other known coatings. There can be selected a single coating polymer, or a mixture of polymers. Additionally, the polymer coating or coatings may contain conductive components therein, such as carbon black in an amount for example, of from about 10 to about 70 weight percent, and preferably from about 20 to about 50 weight percent. Specific examples of coatings are fluorocarbon polymers, acrylate polymers, methacrylate polymers, silicone polymers, and the like.

A particularly preferred coated carrier for use in embodiments to make developer compositions is formed from 80 μm steel core particles (such as those supplied by Hoeganaes North America Corporation) coated with about 0.2% (by wt.) of methylsilsesquioxane Silicone Resin and about 1.0% (by wt.) PMMA.

Imaging methods are also envisioned with the toners of the present disclosure. Suitable imaging methods that utilize toner particles are known in the art and include, for example, but are not limited to, the various patents mentioned herein as well as U.S. Pat. Nos. 4,585,884, 4,584,253, 4,563,408, and 4,265,990, the entire disclosures of which are incorporated herein by reference.

The toner compositions prepared according to the present disclosure provide excellent results in electrostatographic printing operations. In particular, the toner compositions, including the treated aerosil particles, possess good triboelectric charge properties, and good admix times.

An example is set forth hereinbelow and is illustrative of different compositions and conditions that can be utilized in practicing the disclosure. All proportions are by weight unless otherwise indicated. It will be apparent, however, that the disclosure can be practiced with many types of compositions and can have many different uses in accordance with the disclosure above and as pointed out hereinafter.

EXAMPLES

Comparative Example 1

Cyan Toner with Zinc Stearate

A cyan toner is prepared by melt mixing together 12.7% by weight of a dispersion of PB15:3 pigment and polyester resin (3.8% by weight pigment loading total) in a propoxylated bisphenol A fumarate resin having a gel content of about 8% by weight. The toner also comprises as external surface additive package including 3.36% by weight HMDS treated silica with a 40 nanometer average particle diameter, 1.93% by weight decyltrimethoxysilane (DTMS) treated titania with a 40 nanometer average particle diameter (SMT-5103, available from Tayca Corporation), and 0.5% by weight Zinc Stearate L available from Ferro Corporation.

The toner has a volume median particle size of about 8.3 μm, with percent fines less than 5 μm of no more than 15% by number as measured by a Coulter Counter.

This toner is formed into a developer by combining with a carrier comprised of a 80 μm steel core (supplied by Hoeganaes North America Corporation) coated with 1% by weight PMMA (supplied by Soken) at 200° C.

Example 1

Cyan Toner with Magnesium Stearate

A cyan toner is prepared following the procedures of Comparative Example 1, except that it contains 0.5% by weight magnesium stearate MM-2 from NOF Corporation, Japan, rather than zinc stearate.

Comparative Example 2

Cyan Toner with Calcium Stearate

A cyan toner is prepared by melt mixing together 12.7% by weight of a dispersion of PB15:3 pigment and polyester resin (3.8% by weight pigment loading total) in a propoxylated bisphenol A fumarate resin having a gel content of about 8% by weight. The toner also comprises as external surface additive package including 4.3% by weight polydimethylsiloxane (PDMS) treated silica with a 40 nanometer average particle diameter (RY50, available from Nippon Aerosil), 0.9% by weight isobutyltrimethoxysilane (I-BTMS) treated titania with a 40 nanometer average particle diameter, and 0.1% by weight calcium stearate.

The toner has a volume median particle size of about 8.3 μm, with percent fines less than 5 μm of no more than 15% by number as measured by a Coulter Counter.

This toner is formed into a developer by combining with a carrier comprised of a 80 μm steel core (supplied by Hoeganaes North America Corporation) coated with 1% by weight PMMA (supplied by Soken) at 200° C.

Example 2

Cyan Toner with Magnesium Stearate

A cyan toner is prepared following the procedures of Comparative Example 2, except that it contains 0.1% by weight magnesium stearate rather than calcium stearate.

Triboelectric Charge Sensitivity to Toner Age

Figure 2:
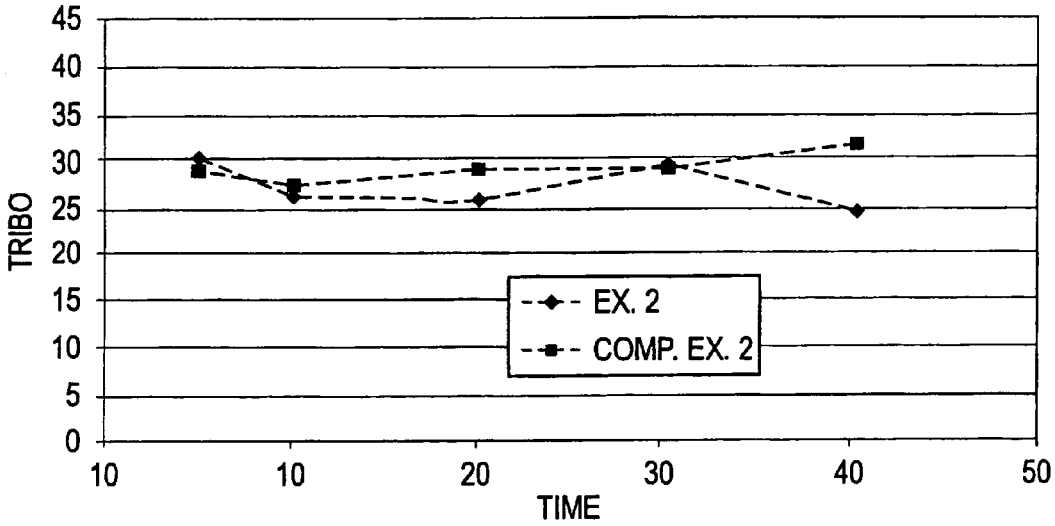
FIG. 2 is a graph showing measured triboelectric charge for control developers and developers according to another embodiment of the disclosure, as a function of simulated toner age.

The stability of the triboelectric charge on the toner particles is also determined as a function of simulated toner age. As a surrogate of toner age or residence time in a xerographic housing, the developers are aggressively mixed in a paint shaker (Red Devil 5400, modified to operate between 600 and 650 RPM) for periods of 5, 10, 20, 30 and 40 minutes. The triboelectric charge is measured for the developers conditioned at B-zone, that is, 70 degrees F. and 50% relative humidity. The results are shown in FIGS. 1 and 2.

Comparison of the results of Comparative Example 1 with Comparative Example 1 and Example 1 shows that substitution of the external additive package using magnesium stearate for the external additive package using zinc stearate provides slightly decreased triboelectric charge. However, it is believed that the triboelectric charge of the developer of Example 1 could be increased by slight modification of the component amounts. Comparison of the results of Comparative Example 2 with Example 2 shows that substitution of the external additive package using magnesium stearate for the external additive package using calcium stearate provides comparable triboelectric charge.

Example 3

Comparison of Reactivity of Stearates

To quantitatively determine the reactivity of various stearates, and thus their likely contribution to fuser failure, various stearates are reacted with an amino functionalized silicone oil from Wacker-Chemie, which is used in xerographic fusers to assist in paper release after fusing. In particular, the amino oil is variously mixed with stearic acid, zinc stearate, calcium stearate, aluminum stearate, magnesium stearate, and aluminum mono stearate.

Figure 3:
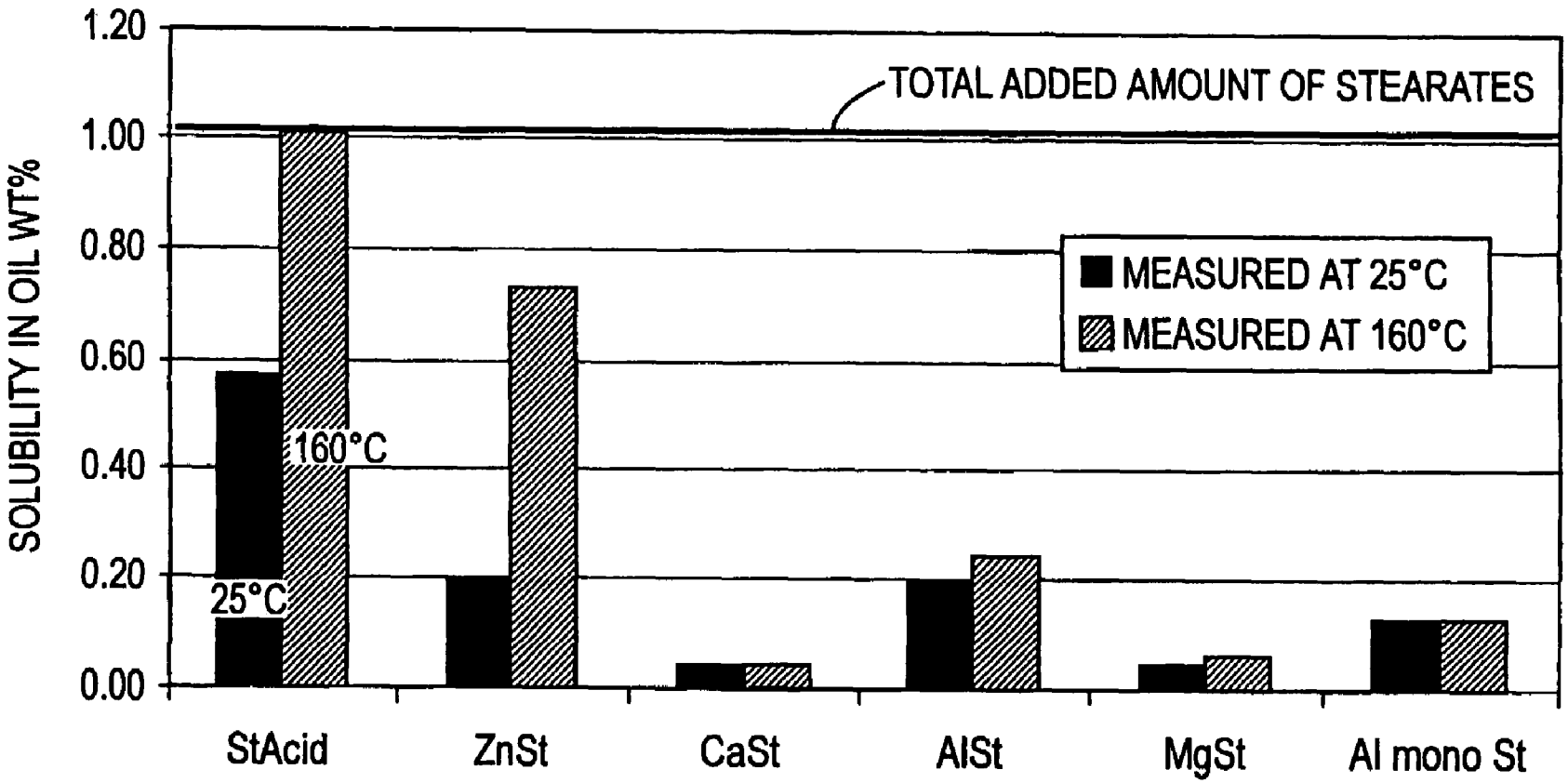
FIG. 3 is a graph showing solubility of various stearates in an amino oil.

In a first test, the solubility of the stearates in the amino oil is assessed. The solubility is measured first at low temperature (25° C.), and then over night at an elevated temperature (160° C.). The results are shown in FIG. 3.

Figure 4:
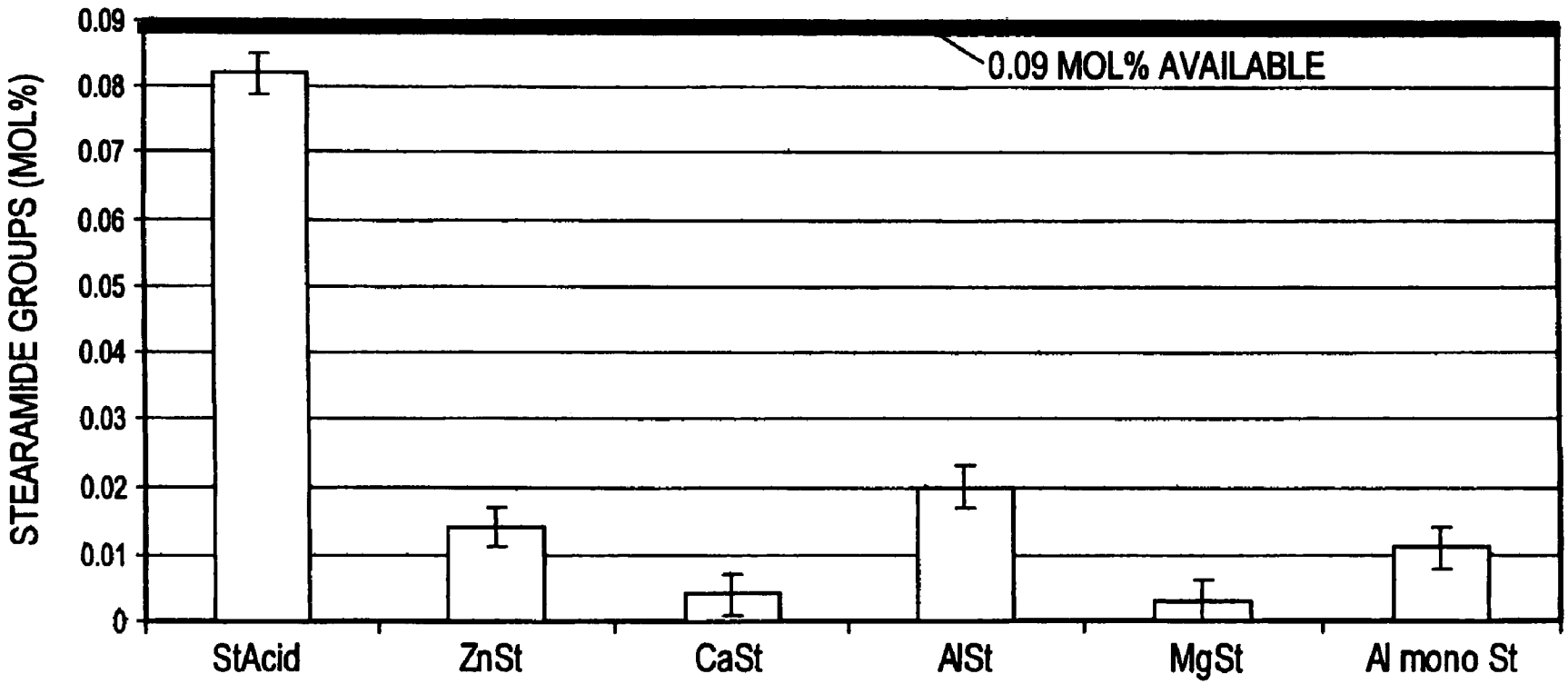
FIG. 4 is a graph showing amount of stearamide groups formed by various stearates in an amino oil.

In a second test, the reactivity of the stearates with the amino oil is indirectly measured by measuring the amount of stearamide groups formed, which is directly related to the reaction of the materials. The results are shown in FIG. 4.

This testing shows that magnesium stearate is much less reactive with the amino oil than stearic acid, or the commonly used zinc stearate. The results also show that the relative reactivity of the magnesium stearate is very close to that of calcium stearate. In actual machine testing, calcium stearate has been shown to improve fuser roll life when compared to zinc stearate. The reason for this is that the calcium stearate is less reactive with the amino functionalized oil.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A toner composition comprising:

a binder, a colorant, and a surface additive package comprising a surface treated silica in an amount of about 1 to about 10 weight percent, a surface treated titania in an amount of about 0.1 to about 5 weight percent, and magnesium stearate in an amount of about 0.01 to about 10 weight percent.

2. A toner composition according to claim 1, wherein said toner composition comprises:

from about 2.3 to about 4.3 weight percent surface treated silica, from about 0.4 to about 0.9 weight percent surface treated titania, and from about 0.1 to about 0.2 weight percent magnesium stearate.

3. A toner composition according to claim 1, wherein said surface treated silica comprises a polydimethylsiloxane surface treated silica.

4. A toner composition according to claim 1, wherein said surface treated silica is present in an amount of from about 1 to about 5 percent by weight.

5. A toner composition according to claim 1, wherein said surface treated silica is the only surface treated silica introduced into the toner composition.

6. A toner composition according to claim 1, wherein said surface treated silica is the only xerographically active silica present in the toner composition.

7. A toner composition according to claim 1, wherein said surface treated silica comprises two different surface treated silicas.

8. A toner composition according to claim 1, wherein said surface treated titania is a hydrophobic surface treated titania.

9. A toner composition according to claim 1, wherein said surface treated titania is surface treated with a material selected from the group consisting of decylsilane, decyltrimethoxysilane, and isobutyltrimethoxysilane.

10. A toner composition according to claim 1, wherein said surface treated titania is present in an amount of from about 0.02 to about 1.5 percent by weight.

11. A toner composition according to claim 1, wherein said magnesium stearate has a purity of greater than 85%.

12. A toner composition according to claim 1, wherein said magnesium stearate is present in an amount of from about 0.05 to about 0.5 percent by weight.

13. A toner composition according to claim 1, wherein said magnesium stearate is the only metal carboxylate present in the toner composition.

14. A toner composition according to claim 1, wherein said magnesium stearate is the only metal stearate present in the toner composition.

15. A toner composition according to claim 1, wherein said toner composition has a triboelectric charge from about 10 μC/g to about 60 μC/g.

16. A toner composition according to claim 1, wherein the colorant is selected from the group consisting of black, cyan, magenta, yellow, red, orange, green, and violet.

17. A developer comprising:

the toner composition of claim 1, and a carrier.

18. An electrographic image development device, comprising the developer composition of claim 17.

19. An electrographic image development device, comprising the toner composition of claim 1.

20. A process for the preparing a toner composition, comprising:

mixing a resin and a colorant to form toner particles, and applying to an external surface of said toner particles, a surface additive package comprising a surface treated silica in an amount of about 1 to about 10 weight, a surface treated titania in an amount of about 0.1 to about 5 weight, and magnesium stearate in an amount of about 0.01 to about 10 weight percent.

* * * * *